US008221614B2

(12) United States Patent
Germaine et al.

(10) Patent No.: US 8,221,614 B2
(45) Date of Patent: Jul. 17, 2012

(54) BASE OIL FORMULATIONS

(75) Inventors: Gilbert Robert Bernard Germaine, Petit Couronne (FR); David John Wedlock, Chester (GB)

(73) Assignee: Shell Oil Company, Houston, TX (US)

( * ) Notice: Subject to any disclaimer, the term of this patent is extended or adjusted under 35 U.S.C. 154(b) by 117 days.

(21) Appl. No.: 12/745,930

(22) PCT Filed: Dec. 4, 2008

(86) PCT No.: PCT/EP2008/006675

§ 371 (c)(1),
(2), (4) Date: Jun. 3, 2010

(87) PCT Pub. No.: WO2009/071608

PCT Pub. Date: Jun. 11, 2009

(65) Prior Publication Data

US 2010/0268004 A1 Oct. 21, 2010

(30) Foreign Application Priority Data

Dec. 7, 2007 (EP) ..... 07122612

(51) Int. Cl.
*C10M 105/04* (2006.01)

(52) U.S. Cl. ..... 208/19; 208/14; 208/950; 508/110; 585/1; 585/6.3

(58) Field of Classification Search ..... 208/14, 208/24, 950, 19
See application file for complete search history.

(56) References Cited

U.S. PATENT DOCUMENTS

| | | | | |
|---|---|---|---|---|
| 4,125,566 | A | 11/1978 | Trin Dinh et al. | 206/676 R |
| 4,478,955 | A | 10/1984 | Pesa et al. | 518/713 |
| 4,943,672 | A | 7/1990 | Hamner et al. | 585/737 |
| 5,059,299 | A | 10/1991 | Cody et al. | 208/27 |
| 6,790,386 | B2 * | 9/2004 | Fefer et al. | 252/570 |
| 7,252,753 | B2 * | 8/2007 | Rosenbaum et al. | 208/14 |
| 7,285,206 | B2 * | 10/2007 | Germaine | 208/108 |
| 7,332,072 | B2 * | 2/2008 | Germaine et al. | 208/108 |
| 7,497,941 | B2 * | 3/2009 | Germaine | 208/60 |
| 7,981,270 | B2 * | 7/2011 | Rosenbaum et al. | 208/18 |
| 2004/0065581 | A1 | 4/2004 | Jiang et al. | 208/18 |
| 2005/0098476 | A1 | 5/2005 | Miller | 208/19 |
| 2008/0051477 | A1 * | 2/2008 | Dierickx et al. | 518/726 |
| 2008/0116110 | A1 * | 5/2008 | Germaine | 208/107 |
| 2008/0149529 | A1 | 6/2008 | Rosenbaum et al. | 208/19 |

FOREIGN PATENT DOCUMENTS

| | | |
|---|---|---|
| EP | 147873 | 7/1985 |
| EP | 582347 | 2/1994 |
| EP | 583836 | 2/1994 |
| EP | 668342 | 8/1995 |
| EP | 776959 | 6/1997 |
| GB | 2077289 | 12/1981 |
| WO | WO9201657 | 2/1992 |
| WO | WO9220759 | 11/1992 |
| WO | WO9410264 | 5/1994 |
| WO | WO9920720 | 4/1999 |
| WO | WO9934917 | 7/1999 |
| WO | WO02070627 | 9/2002 |
| WO | WO02070629 | 9/2002 |
| WO | WO2004046281 | 6/2004 |
| WO | WO2004081145 | 9/2004 |
| WO | WO2006136594 | 12/2006 |

OTHER PUBLICATIONS

Klamann D.: Lubricants and related products, Verlag Chemie GmbH, Weinheim, 1984 pp. 330-337.

* cited by examiner

*Primary Examiner* — Ellen McAvoy

(57) ABSTRACT

Base oil formulation containing (i) a Fischer-Tropsch derived light base oil and (ii) a Fischer-Tropsch derived gas oil. The formulation can be prepared by back-blending a Fischer-Tropsch derived light base oil with a Fischer-Tropsch derived gas oil, for instance derived from the same Fischer-Tropsch synthesis. Also provided is the use of a Fischer-Tropsch derived gas oil in a base oil formulation containing a Fischer-Tropsch derived light base oil, for the purpose of improving the cold flow properties of the formulation while maintaining its flash point above a desired target value, and/or for the purpose of reducing the concentration of a cold flow additive in the formulation, preferably with less of a reduction in the flash point of the formulation than theory would have predicted to occur due to the incorporation of the Fischer-Tropsch derived gas oil.

6 Claims, No Drawings

BASE OIL FORMULATIONS

PRIORITY CLAIM

The present application claims priority to European Patent Application 07122612.0 filed 7 Dec. 2007.

FIELD OF THE INVENTION

This invention relates to base oil formulations and to their preparation and uses, as well as to the use of certain types of oils in base oil formulations for new purposes.

BACKGROUND TO THE INVENTION

The Fischer-Tropsch condensation process is a reaction which converts carbon monoxide and hydrogen into longer chain, usually paraffinic, hydrocarbons in the presence of an appropriate catalyst and typically at elevated temperatures (e.g. 125 to 300° C., preferably 175 to 250° C.) and/or pressures (e.g. 5 to 100 bar, preferably 12 to 50 bar).

The Fischer-Tropsch process can be used to prepare a range of hydrocarbon fuels, including LPG, naphtha, kerosene and gas oil fractions. Of these, the gas oils have been used in middle distillate fuel compositions such as in particular automotive diesel fuels, typically in blends with petroleum derived gas oils. The heavier fractions can yield, following hydroprocessing and vacuum distillation, a series of base oils having different distillation properties and viscosities, which are useful as lubricating base oil stocks. These base oils have a wide range of uses, including as lubricants, as dielectric fluids (for example electrical oils or transformer oils), as hydraulic fluids (for example in shock absorbers) and as process oils for instance in elastomer production.

WO-A-02070627 and WO-A-02070629, for example, describe processes for preparing iso-paraffinic base oils from a wax made by a Fischer-Tropsch process. Such Fischer-Tropsch derived base oils tend to have excellent low temperature properties, for example low pour points, and are also attractive because of the relatively simple process used to make them as compared to similar oils prepared from mineral crude sources.

The products of such a process include, inter alia, a gas oil and a base oil stream having a nominal kinematic viscosity at 100° C. (VK 100) of about 4 centistokes, which is suitable for use in lubricant formulations.

They also include a light base oil, of VK 100 from about 2 to 3 centistokes, which has boiling points between the final boiling point of the gas oil and the initial boiling point of the 4 centistoke base oil. The boiling range of this intermediate product is determined by those of the gas oil and the 4 centistoke base oil, and the initial boiling point of the 4 centistoke oil is fixed due to the viscosity and volatility specifications with which it has to comply. This leads to a relatively low degree of control over the boiling range, and hence over related properties such as viscosity and pour point, for the 3 centistoke light base oil. This in turn can restrict the potential applications of the light oil, as it can be difficult to formulate to a desired specification. Its viscosity and pour point may for example be inappropriately high for the oil to be of use as an electrical oil, yet its viscosity will also be too low for it to be of use as a lubricant oil.

Thus it would be desirable to be able to exercise greater control over the properties of the light base oil cut, so as to extend its potential applications. Depending on its intended use, a base oil often needs to comply with strict requirements regarding its viscosity and viscosity index, its flash point, its distillation properties and its flow properties (in particular its low temperature performance). A high flash point is particularly important for base oil formulations which are intended for use as electrical oils, especially when used in a high temperature environment or in situations involving elevated peak temperatures. Thus if a light base oil is to be of use in such a context, not only its viscosity and its pour point, but also its flash point, must be carefully controlled so as to meet applicable specifications.

It has now surprisingly been found that when formulating a Fischer-Tropsch derived light base oil, improved properties can be achieved without an undesirably high reduction in flash point, by the addition of a Fischer-Tropsch derived gas oil. Thus a Fischer-Tropsch derived gas oil may be used to tune the properties of a light base oil. This in turn can increase the versatility of the light oil, and in particular can render the resultant blend suitable for use as an electrical oil.

SUMMARY OF THE INVENTION

According to a first aspect of the present invention there is provided a base oil formulation containing (i) a Fischer-Tropsch derived light base oil and (ii) a Fischer-Tropsch derived gas oil.

The inclusion of a Fischer-Tropsch derived gas oil can allow the properties of the light base oil product to be more readily tailored to meet a desired specification.

In particular, it can reduce both the viscosity and more particularly the pour point of the light base oil, so that the overall formulation can be of use as for example an electrical oil or a shock absorber fluid.

Surprisingly, however, as described in more detail below, the gas oil does not cause too great a reduction in the flash point of the formulation. Thus the invention can provide alternative uses for Fischer-Tropsch derived light base oils, and increase the options available to those wishing to formulate base oil products.

DETAILED DESCRIPTION OF THE INVENTION

In the present context, the term "Fischer-Tropsch derived" means that a material is, or derives from, a synthesis product of a Fischer-Tropsch condensation process. The term "non-Fischer-Tropsch derived" may be interpreted accordingly. A Fischer-Tropsch derived base oil will therefore be a hydrocarbon stream of which a substantial portion, except for added hydrogen, is derived directly or indirectly from a Fischer-Tropsch condensation process.

A Fischer-Tropsch derived product may also be referred to as a GTL product.

Hydrocarbon products may be obtained directly from the Fischer-Tropsch reaction, or indirectly for instance by fractionation of Fischer-Tropsch synthesis products or from hydrotreated Fischer-Tropsch synthesis products.

Hydrotreatment can involve hydrocracking to adjust the boiling range (see, e.g. GB-B-2077289 and EP-A-0147873) and/or hydroisomerisation which can improve cold flow properties by increasing the proportion of branched paraffins. EP-A-0583836 describes a two step hydrotreatment process in which a Fischer-Tropsch synthesis product is firstly subjected to hydroconversion under conditions such that it undergoes substantially no isomerisation or hydrocracking (this hydrogenates the olefinic and oxygen-containing components), and then at least part of the resultant product is hydroconverted under conditions such that hydrocracking and isomerisation occur to yield a substantially paraffinic hydrocarbon product. The desired fraction(s) may subsequently be isolated for instance by distillation. Other post-synthesis treatments, such as polymerisation, alkylation, distillation, cracking-decarboxylation, isomerisation and hydroreforming, may be employed to modify the properties of Fischer-Tropsch condensation products, as described for instance in U.S. Pat. No. 4,125,566 and U.S. Pat. No. 4,478,955.

Typical catalysts for the Fischer-Tropsch synthesis of paraffinic hydrocarbons comprise, as the catalytically active component, a metal from Group VIII of the periodic table, in particular ruthenium, iron, cobalt or nickel. Suitable such catalysts are described for instance in EP-A-0 583 836 (pages 3 and 4).

An example of a Fischer-Tropsch process is the SMDS (Shell Middle Distillate Synthesis) described in "The Shell Middle Distillate Synthesis Process", van der Burgt et al, paper delivered at the 5th Synfuels Worldwide Symposium, Washington D.C., November 1985; see also the November 1989 publication of the same title from Shell International Petroleum Company Ltd, London, UK. This process (also sometimes referred to as the Shell "Gas-To-Liquids" or "GTL" technology) produces middle distillate range products by conversion of a natural gas (primarily methane) derived synthesis gas into a heavy long chain hydrocarbon (paraffin) wax which can then be hydroconverted and fractionated to produce liquid transport fuels such as the gas oils useable in diesel fuel compositions. Base oils, having a range of viscosities and including both light and heavier fractions, may also be produced by such a process. By virtue of the Fischer-Tropsch process, a Fischer-Tropsch derived fuel or fuel component has essentially no, or undetectable levels of, sulphur and nitrogen.

Compounds containing these heteroatoms tend to act as poisons for Fischer-Tropsch catalysts and are therefore removed from the synthesis gas feed. This can bring additional benefits to base oil formulations in accordance with the present invention.

Further, the Fischer-Tropsch process as usually operated produces no or virtually no aromatic components. The aromatics content of a Fischer-Tropsch derived oil, suitably determined by ASTM D-4629, will typically be below 1 wt %, preferably below 0.5 wt % and more preferably below 0.1 wt %.

Generally speaking, Fischer-Tropsch derived hydrocarbon products have relatively low levels of polar components, in particular polar surfactants, for instance compared to petroleum derived fuels. This may contribute to improved anti-foaming and dehazing performance. Such polar components may include for example oxygenates, and sulphur and nitrogen containing compounds. A low level of sulphur in a Fischer-Tropsch derived product is generally indicative of low levels of both oxygenates and nitrogen containing compounds, since all are removed by the same treatment processes.

A Fischer-Tropsch derived light base oil is a base oil which is derived from a Fischer-Tropsch derived wax. As described above, it is a base oil cut which has a boiling range between the initial boiling point of a 4 centistoke base oil and the final boiling point of a gas oil. Typically, it will be a 350 to 400° C. cut from a full range dewaxing of the Fischer-Tropsch waxy raffinate.

Such a light base oil will suitably have a kinematic viscosity at 100° C. (VK 100, as measured by ASTM D-445) of from 2.1 to 3.5 centistokes, preferably from 2.5 to 3 centistokes.

It will suitably have a kinematic viscosity at 40° C. (VK 40, also measured by ASTM D-445) of from 7 to 12 centistokes, preferably from 8 to 11 centistokes.

The Fischer-Tropsch derived light base oil used in the present invention may be either a Group II or a Group III base oil, preferably the latter. A Group II base oil may be defined as a base oil which contains at least 90 wt % of saturates and no more than 0.03 wt % sulphur, and has a viscosity index of at least 80 and less than 120. These qualities tend to be achieved by subjecting the oil to relatively severe processing, typically hydroprocessing. A Group III base oil may be defined as a base oil which fulfils the same saturates and sulphur content requirements as a Group II base oil, but which also has a viscosity index of greater than 120.

Again these properties tend to be achieved by relatively severe hydroprocessing and catalytic dewaxing steps.

The light base oil used in the present invention will thus suitably have a viscosity index (ASTM D-2270) of from 105 to 124, preferably greater than 120, more preferably from 121 to 123.

It may have a Noack volatility (CEC L-40-A-93) of from 40 to 65 wt %.

The flash point of the light base oil, as measured by ASTM D-92, is suitably 170° C. or higher, preferably 180° C. or higher, yet more preferably 190 or 195° C. or higher. It has generally been found that the flash points of Fischer-Tropsch derived base oils can be advantageously high as compared to mineral oil derived base oils at a given viscosity.

Flash points may also be measured using the more exacting standard test method ASTM D-93.

The pour point of the light base oil (ASTM D-5950), is preferably −39° C. or lower, more preferably −40 or −42 or −45° C. or lower.

Fischer-Tropsch derived base oils tend to have good purity and a high paraffinic content, and to contain a continuous series of iso-paraffins having n, n+1, n+2, n+3 and n+4 carbon atoms, as described below. Such base oils also tend to have excellent low temperature properties, and are also relatively simple to produce in comparison to their mineral derived counterparts.

The Fischer-Tropsch derived light base oil used in the present invention is suitably obtained by hydrocracking a Fischer-Tropsch wax and preferably dewaxing the resultant waxy raffinate. This raffinate can be distilled to produce a number of different products, including a base oil stream having a VK 100 of around 4 centistokes and a lower boiling dewaxed gas oil.

The base oil used in the present invention may be derived from an intermediate stream between these two products. Its boiling range and viscosity will therefore be determined by those required for the 4 centistokes base oil and the gas oil streams.

Since the light base oil used in the present invention is derived from a Fischer-Tropsch wax, it will be largely paraffinic in nature, and will typically contain a major proportion of iso-paraffins. Suitably, the base oil is a paraffinic base oil having a total paraffin content of at least 80 wt %, preferably at least 85 or 90 wt %. It suitably has a saturates content (as measured by IP-368) of greater than 98 wt %. Preferably it comprises a series of iso-paraffins having n, n+1, n+2, n+3 and n+4 carbon atoms, where n is from 20 to 35. Preferably the saturates content of the base oil is greater than 99 wt %, more preferably greater than 99.5 wt %. It preferably has a maximum n-paraffin content of 0.5 wt %.

The base oil preferably has a content of naphthenic compounds of from 0 to less than 20 wt %, more preferably of from 1 to 10 wt %.

It will suitably have a boiling range from 340 to 400° C.

The content of naphthenic compounds in the light base oil, and the presence of the desired continuous series of iso-paraffins, may be measured by the Field Ionisation Mass Spectrometry (FIMS) technique. According to this technique, an oil sample is firstly separated into a polar (aromatic) phase and a non-polar (saturates) phase by the high performance liquid chromatography (HPLC) method IP 368/01 but using pentane instead of hexane as the mobile phase. The aromatic and saturates fractions are then analysed using for instance a Finnigan MAT90 mass spectrometer equipped with a FD/FI interface, the FI (a "soft" ionisation technique) being used to determine hydrocarbon types in terms of carbon number and hydrogen deficiency.

The type classification of compounds in mass spectrometry is determined by the characteristic ions formed and is normally classified by "z number". This is given by the general formula for all hydrocarbon species: $C_nH_{2n+z}$. Because the saturates phase is analysed separately from the aromatic phase it is possible to determine the content of the different iso-paraffins having the same stoichiometry or n-number. The results from the mass spectrometer can be processed using commercially available software (for example Poly 32, available from Sierra Analytics LLC, 3453 Dragoo Park Drive, Modesto, Calif. GA95350 USA) to determine the relative proportions of each hydrocarbon type.

The light base oil used in a formulation according to the invention, which preferably contains the above described continuous series of iso-paraffins, is suitably obtained by hydroisomerisation of a paraffinic wax, preferably followed by some type of dewaxing, such as solvent or catalytic dewaxing. The paraffinic wax may be a slack wax. More preferably the paraffinic wax is a Fischer-Tropsch derived wax, because of its purity and high paraffinic content, as well as the fact that such waxes result in a product containing a continuous series of iso-paraffins having n, n+1, n+2, n+3 and n+4 carbon atoms in the desired molecular weight range.

Examples of Fischer-Tropsch processes which can be used to prepare the Fischer-Tropsch derived base oil are the so-called commercial Slurry Phase Distillate technology of Sasol, the Shell Middle Distillate Synthesis process referred to above and the "AGC-21" Exxon Mobil process. These and other processes are for example described in more detail in EP-A-776959, EP-A-668342, U.S. Pat. No. 4,943,672, U.S. Pat. No. 5,059,299, WO-A-9934917 and WO-A-9920720. Typically the products of these Fischer-Tropsch syntheses will comprise hydrocarbons having from 1 to 100 or even more than 100 carbon atoms. Such products will comprise normal paraffins, iso-paraffins, oxygenated components and unsaturated components.

Where a base oil is one of the desired iso-paraffinic products it may be advantageous to use a relatively heavy Fischer-Tropsch derived feed. Such a feed suitably contains at least 30 wt %, preferably at least 50 wt % and more preferably at least 55 wt % of compounds having at least 30 carbon atoms. Furthermore the weight ratio in the feed of compounds having at least 60 carbon atoms to those having at least 30 carbon atoms is preferably at least 0.2, more preferably at least 0.4 and most preferably at least 0.55.

Preferably the Fischer-Tropsch derived feed comprises a $C_{20+}$ fraction having an ASF-alpha value (Anderson-Schulz-Flory chain growth factor) of at least 0.925, preferably at least 0.935, more preferably at least 0.945, even more preferably at least 0.955. Such a Fischer-Tropsch derived feed can be obtained by any process which yields a suitably heavy product as described above. An example of a suitable Fischer-Tropsch process is described in WO-A-9934917.

A Fischer-Tropsch derived base oil will contain no or very little sulphur and nitrogen containing compounds. This is typical for a product derived from a Fischer-Tropsch reaction, which uses synthesis gas containing almost no impurities. Sulphur and nitrogen levels will generally be below the detection limits, which are currently 5 mg/kg for sulphur and 1 mg/kg for nitrogen respectively.

In its broadest sense, the present invention embraces the use of a paraffinic light base oil having one or more of the above described properties, in a base oil formulation with a Fischer-Tropsch derived gas oil, whether or not the base oil is actually Fischer-Tropsch derived.

However the process used to prepare the light base oil will conveniently comprise a Fischer-Tropsch synthesis, a hydroisomerisation step and an optional pour point reducing step, wherein the hydroisomerisation and optional pour point reducing steps are performed by:

(a) hydrocracking/hydroisomerising a Fischer-Tropsch product, and (b) isolating from the product of step (a) a light base oil or base oil intermediate fraction, or more preferably separating the product of step (a) into at least (i) one or more distillate fuel fractions and (ii) a light base oil or base oil intermediate fraction.

If the viscosity and pour point of the base oil obtained in step (b) are as desired no further processing is necessary and the oil can be used directly in a formulation according the invention. If required, however, the pour point of a base oil intermediate fraction may be further reduced in a step (c) by means of solvent or more preferably catalytic dewaxing.

A desired viscosity of base oil may be obtained by isolating (by means of distillation) a product having a suitable boiling range and corresponding viscosity, from an intermediate base oil fraction or from a dewaxed oil. The distillation may be a vacuum distillation step.

The hydroconversion/hydroisomerisation reaction of step (a) is preferably performed in the presence of hydrogen and a catalyst, which catalyst can be chosen from those known to one skilled in the art, examples of which are described in more detail below. The catalyst may in principle be any catalyst known in the art to be suitable for isomerising paraffinic molecules. In general, suitable hydroconversion/hydroisomerisation catalysts are those comprising a hydrogenation component supported on a refractory oxide carrier, such as amorphous silica-alumina (ASA), alumina, fluorided alumina, molecular sieves (zeolites) or mixtures of two or more of these.

Preferred catalysts for use in the hydroconversion/hydroisomerisation step (a) include those comprising platinum and/or palladium as the hydrogenation component. A very much preferred hydroconversion/hydroisomerisation catalyst comprises platinum and palladium supported on an amorphous silica-alumina (ASA) carrier. The platinum and/or palladium is suitably present in an amount of from 0.1 to 5.0 wt %, more suitably from 0.2 to 2.0 wt %, calculated as the element and based on the total weight of the carrier. If both elements are present, the weight ratio of platinum to palladium may vary within wide limits, but is suitably in the range of from 0.05 to 10, more suitably from 0.1 to 5. Examples of suitable noble metal on ASA catalysts are, for instance, disclosed in WO-A-9410264 and EP-A-0582347. Other suitable noble metal-based catalysts, such as platinum on a fluorided alumina carrier, are disclosed in eg, U.S. Pat. No. 5,059,299 and WO-A-9220759.

A second type of suitable hydroconversion/hydroisomerisation catalyst includes those comprising at least one Group VIB metal, preferably tungsten and/or molybdenum, and at least one non-noble Group VIII metal, preferably nickel and/ or cobalt, as the hydrogenation component. Either or both metals may be present as an oxide, a sulphide or a combination thereof.

The Group VIB metal is suitably present in an amount of from 1 to 35 wt %, more suitably from 5 to 30 wt %, calculated as the element and based on the total weight of the carrier. The non-noble Group VIII metal is suitably present in an amount of from 1 to 25 wt %, preferably from 2 to 15 wt %, calculated as the element and based on the total weight of the carrier. A hydroconversion catalyst of this type, which has been found particularly suitable, is one comprising nickel and tungsten supported on fluorided alumina.

The above non-noble metal based catalysts are preferably used in their sulphided form. In order to maintain the sulphided form of the catalyst during use some sulphur needs to be present in the feed, for example at least 10 mg/kg or more preferably from 50 to 150 mg/kg of sulphur.

A preferred catalyst, which can be used in a non-sulphided form, comprises a non-noble Group VIII metal, e.g. iron or nickel, in conjunction with a Group IB metal, e.g. copper, supported on an acidic support. Copper is preferably present to suppress hydrogenolysis of paraffins to methane. The catalyst preferably has a pore volume in the range from 0.35 to 1.10 ml/g as determined by water absorption, a surface area of from 200 to 500 m2/g as determined by BET nitrogen adsorption, and a bulk density of from 0.4 to 1.0 g/ml. The catalyst support is preferably made of an amorphous silica-alumina wherein the alumina may be present within a range of from 5 to 96 wt %, preferably from 20 to 85 wt %. The silica content of such a support, as SiO2, is preferably from 15 to 80 wt %. The support may also contain small amounts, for example from 20 to 30 wt %, of a binder such as alumina, silica, a Group IVA metal oxide, a clay, magnesia, etc., preferably alumina or silica.

The preparation of amorphous silica-alumina microspheres has been described by Ryland, Lloyd B., Tamele, M. W. and Wilson, J. N., in "Cracking Catalysts", Catalysis: Volume VII, Ed. Paul H. Emmett, Reinhold Publishing Corporation, New York, 1960, pp. 5-9. The catalyst may be prepared by co-impregnating the metals from solutions onto the support, drying at 100 to 150° C. and calcining in air at 200 to 550° C. The Group VIII metal may be present in an amount of about 15 wt % or less, preferably from 1 to 12 wt %, whilst the Group IB metal is usually present in a lower amount: for example the weight ratio of the Group IB metal to the Group VIII metal may be from about 1:2 to about 1:20.

A typical catalyst is specified below:

| | |
|---|---|
| Ni, wt % | 2.5-3.5 |
| Cu, wt % | 0.25-0.35 |
| Al2O3-SiO2 wt % | 65-75 |
| Al2O3 (binder) wt % | 25-30 |
| Surface area | 290-325 m2/g |
| Pore volume (Hg) | 0.35-0.45 ml/g |
| Bulk density | 0.58-0.68 g/ml. |

Another class of suitable hydroconversion/hydroisomerisation catalysts includes those based on molecular sieve type materials, suitably comprising at least one Group VIII metal component, preferably Pt and/or Pd, as the hydrogenation component. Suitable zeolitic and other aluminosilicate materials, then, include Zeolite beta, Zeolite Y, Ultra Stable Y, ZSM-5, ZSM-12, ZSM-22, ZSM-23, ZSM-48, MCM-68, ZSM-35, SSZ-32, ferrierite, mordenite and silica-aluminophosphates such as SAPO-11 and SAPO-31. Examples of suitable hydroconversion/hydroisomerisation catalysts are, for instance, described in WO-A-9201657. Combinations of these catalysts are also possible.

Suitable hydroconversion/hydroisomerisation processes are those involving a first step wherein a zeolite beta or ZSM-48 based catalyst is used and a second step wherein a ZSM-5, ZSM-12, ZSM-22, ZSM-23, ZSM-48, MCM-68, ZSM-35, SSZ-32, ferrierite or mordenite based catalyst is used. Of the latter group ZSM-23, ZSM-22 and ZSM-48 are preferred. Examples of such processes are described in US-A-20040065581, which discloses the use of a first step catalyst comprising platinum and zeolite beta and a second step catalyst comprising platinum and ZSM-48.

Combination processes in which the Fischer-Tropsch product is first subjected to a first hydroisomerisation step using an amorphous catalyst comprising a silica-alumina carrier as described above, followed by a second hydroisomerisation step using a catalyst which comprises a molecular sieve, have also been identified as preferred processes by which to prepare a base oil for use in the present invention. Preferably the first and second hydroisomerisation steps are performed in series flow. More preferably the two steps are performed in a single reactor comprising beds of the above amorphous and/or crystalline catalysts.

In step (a) the Fischer-Tropsch feed is contacted with hydrogen in the presence of the catalyst at elevated temperature and pressure. The temperature will typically be in the range from 175 to 380° C., preferably higher than 250° C. and more preferably from 300 to 370° C. The pressure will typically be in the range from 10 to 250 bar and preferably from 20 to 80 bar. Hydrogen may be supplied at a gas hourly space velocity of from 100 to 10000 Nl/l/hr, preferably from 500 to 5000 Nl/l/hr. The hydrocarbon feed may be provided at a weight hourly space velocity of from 0.1 to 5 kg/l/hr, preferably higher than 0.5 kg/l/hr and more preferably lower than 2 kg/l/hr.

The ratio of hydrogen to hydrocarbon feed may range from 100 to 5000 Nl/kg and is preferably from 250 to 2500 Nl/kg.

The conversion in step (a), defined as the weight percentage of the feed boiling above 370° C. which reacts per pass to a fraction boiling below 370° C., is suitably at least 20 wt %, preferably at least 25 wt %, but preferably not more than 80 wt % and more preferably not more than 65 wt %. The feed as used in the above definition is the total hydrocarbon feed to step (a), thus including any optional recycle of a high boiling fraction which may be obtained in step (b).

In step (b) the product of step (a) is preferably separated into one or more distillate fuel fractions and a base oil or base oil precursor fraction having the desired viscosity. If the pour point of the base oil or precursor is not in the desired range it may be further reduced by means of a dewaxing step (c), preferably by catalytic dewaxing. In such an embodiment it may be a further advantage to dewax a wider boiling fraction of the product of step (a). From the resulting dewaxed product the light base oil and optionally other oils having desired viscosities can then be isolated for instance by distillation. Dewaxing is preferably performed by catalytic dewaxing, as for example described in WO-A-02070627, which publication is hereby incorporated by reference (see in particular page 8 line 27 to page 11 line 6 for examples of suitable dewaxing conditions and catalysts). The final boiling point of the feed to the dewaxing step (c) may be the final boiling point of the product of step (a) or lower if desired. Typically, the feed to the catalytic dewaxer will comprise C18 to C40 hydrocarbons.

Prior to use in a formulation according to the invention, for instance after a dewaxing step (c), the base oil may be subjected to one or more further treatments such as hydrofinishing, as described for example at page 11 line 7 to page 12 line 12 of WO-A-02070627.

The Fischer-Tropsch derived gas oil used in a formulation according to the invention may also be distilled from a Fischer-Tropsch derived wax. It too should be subjected to dewaxing (preferably catalytic) before blending with the light base oil. This will increase its iso-paraffin content, and thus improve its cold flow properties as compared to a standard Fischer-Tropsch derived gas oil which has not been subjected to catalytic dewaxing. The pour point (ASTM D-5950) of the Fischer-Tropsch derived gas oil used in the present invention is preferably −42° C. or below, more preferably −45 or −50 or −51° C. or below.

Thus, according to an embodiment of the invention, both the light base oil and the gas oil may be prepared from the same Fischer-Tropsch derived wax stream. For example, the wax may be subjected to hydrocracking and dewaxing, and the resultant waxy raffinate may be distilled to provide, amongst other products, both a light base oil and a gas oil fraction. These two fractions may then be blended together (i.e. the gas oil can be "back-blended" into the base oil stream) to prepare an improved base oil formulation according to the invention.

One way in which this may be achieved is by carrying out the steps (a) and (b) as described above, and in step (b) separating the step (a) product into at least a gas oil fraction and an appropriate base oil or base oil precursor fraction. The gas oil is suitably subjected to a dewaxing step, preferably a catalytic dewaxing step, and may then be blended with the base oil in an appropriate proportion in accordance with the present invention. Alternatively, both the base oil and the gas oil fractions may be dewaxed together, optionally with other fractions also present, prior to their separation and their subsequent back-blending.

A suitable process for the simultaneous production of both a Fischer-Tropsch derived gas oil and a Fischer-Tropsch derived light base oil is for instance that described in WO-A-02070627.

A Fischer-Tropsch derived gas oil will usually contain a majority (for instance 95 vol % or greater) of components having boiling points within the typical diesel fuel ("gas oil") range, ie, from about 150 to 400° C. or from 170 to 370° C. It will suitably have a 90 vol % distillation temperature of from 300 to 370° C.

A Fischer-Tropsch derived gas oil will typically have a density (IP-365/97) from 0.76 to 0.79 g/cm3 at 15° C.; a cetane number (ASTM D-613) greater than 70, suitably from 74 to 85; a VK 40 (ASTM D-445) from 2 to 4.5, preferably from 2.5 to 4.0, more preferably from 2.9 to 3.7, centistokes; and a sulphur content (ASTM D-2622) of 5 mg/kg or less, preferably of 2 mg/kg or less.

The gas oil will suitably have a flash point (ASTM D-92) of 100° C. or higher, preferably 110° C. or higher, for example from 110 to 120° C.

Preferably a Fischer-Tropsch derived gas oil used in the present invention is a product prepared by a Fischer-Tropsch methane condensation reaction using a hydrogen/carbon monoxide ratio of less than 2.5, preferably less than 1.75, more preferably from 0.4 to 1.5, and ideally using a cobalt containing catalyst. Suitably it will have been obtained from a hydrocracked Fischer-Tropsch synthesis product (for instance as described in GB-B-2077289 and/or EP-A-0147873), or more preferably a product from a two stage hydroconversion process such as that described in EP-A-0583836 (see above). In the latter case, preferred features of the hydroconversion process may be as disclosed at pages 4 to 6, and in the examples, of EP-A-0583836.

Suitably, in accordance with the present invention, a Fischer-Tropsch derived gas oil will consist of at least 70 wt %, preferably at least 80 wt %, more preferably at least 90 or 95 or 98 wt %, most preferably at least 99 or 99.5 or even 99.8 wt %, of paraffinic components. The weight ratio of iso-paraffins to normal paraffins will suitably be greater than 5:1 or 10:1, or in cases greater than 50:1 or 100:1 or 150:1 or 180:1 or even 190:1. The actual value for this ratio will be determined, in part, by the hydroconversion process used to prepare the gas oil from the Fischer-Tropsch synthesis product.

The olefin content of the Fischer-Tropsch derived gas oil is suitably 0.5 wt % or lower. Its aromatics content is suitably 0.5 wt % or lower.

According to the present invention, the base oil formulation may contain a mixture of two or more Fischer-Tropsch derived gas oils.

A formulation according to the invention can benefit, due to inclusion of the Fischer-Tropsch derived gas oil, from a reduced pour point as compared to the light base oil alone. The gas oil also helps to reduce the kinematic viscosity of the formulation, which can also be desirable in the context of for instance hydraulic fluids and electrical oils (the latter requiring a maximum VK 100 of 11 centistokes).

It has been found, however, that the presence of the Fischer-Tropsch derived gas oil does not reduce the flash point of the formulation to the extent that might have been expected in view of the relative vapour pressures of the two components (it being expected that the much more volatile gas oil would dominate the vapour pressure, and hence the overall flash point, of the formulation).

Instead, contrary to expectations, the gas oil can be included in the formulation without reducing the overall flash point below the 140° C. minimum typically desired of for example electrical oils, indicating a potential synergy between the two fuel components. As a result, the present invention can provide more optimised methods for formulating light base oils, in particular to achieve target cold flow properties and/or viscosities and/or other applicable standards whilst at the same time maintaining flash points above a target minimum. For example, a catalytically dewaxed, paraffinic, light base oil, with its associated low temperature and processing benefits, can now be used as the base for a dielectric fluid without the need to include a pour point depressant, and without the need to incorporate a naphthenic base oil as might normally be done for such purposes. A high flash point yet comparatively low viscosity base oil formulation can therefore be prepared with good low temperature performance.

Maintenance of a high flash point is particularly important in applications—typically where the formulation is being used as an electrical oil—where a high overall temperature exposure takes place, and/or where high peak temperatures or so-called hotspots occur in the base oil formulation, and/or where an increase in temperature cannot be easily deferred by the electrical oil due to restrictions in size or heat exchange capacity of a device containing the oil. Examples of such applications are small high capacity transformers, or safety switches.

In a formulation according to the invention, the concentration of the Fischer-Tropsch derived gas oil may be up to 20 wt %, for example up to 18 wt % or up to 15 or 10 wt %. The concentration may be 0.5 wt % or higher, for example 1 or 2 or 3 or 4 or 5 wt % or higher. It may for example be from 5 to 10 wt %.

The concentration of the Fischer-Tropsch derived gas oil will generally be chosen to ensure that the density, calorific value and/or other relevant properties of the overall formulation are within the desired ranges, for instance within commercial or regulatory specifications. The formulation will typically contain a major proportion of the Fischer-Tropsch derived light base oil, by which is meant that its concentration in the formulation may be for example up to 99.5 wt %, or up to 99 or 98 or 97 or 96 or 95 or 94 wt %. Its concentration may be 75 wt % or greater, for example 80 or 82 or 85 wt % or greater.

The Fischer-Tropsch derived light base oil may be the only base oil component in the formulation. Alternatively, it may be used in combination with one or more additional base oil components. The preferred properties of such additional base oil components may be as described above for the Fischer-Tropsch derived light base oil. They may be Fischer-Tropsch derived or non-Fischer-Tropsch derived. The overall formulation will suitably contain less than 20 wt %, preferably less than 10 wt %, of such additional base oil components. Preferably it will not contain any naphthenic base oil components, or will contain only a low quantity (for example 5 or 2 or 1 wt % or less) of naphthenic base oil components.

Examples of additional base oil components include mineral based paraffinic and naphthenic type base oils and synthetic base oils, for example esters, poly alpha olefins, poly alkylene glycols and the like. Of these, esters can be beneficial in order to improve the biodegradability of a base oil formulation. The content of an additional ester base oil, if present, may be from 1 to 30 wt % based on the overall formulation, more preferably from 5 to 25 wt %. Suitable esters are those derivable by reacting an aliphatic mono, di and/or poly carboxylic acid with isotridecyl alcohol under esterification conditions. Examples of such compounds are the isotridecyl ester of octane-1,8-dioic acid, 2-ethylhexane-1,6 dioic acid and dodecane-1,12-dioic acid. Preferably the ester is a so-called pentaerythritol tetrafattyacid ester (PET ester), as made by esterification of pentaerythritol (PET) with branched or linear fatty acids, preferably C6-C10 acids. Such an ester may contain di-PET as an impurity.

It has however been found especially advantageous to use a Fischer-Tropsch derived light base oil as substantially the sole base oil component in a formulation according to the invention. By "substantially" in this context is meant that more than 70 wt %, preferably more than 80 or 90 wt % and most preferably 100 wt % of any base oil components in the formulation are Fischer-Tropsch derived light base oils as described above, or at least light base oils having the preferred properties described above.

The formulation may however contain a mixture of two or more Fischer-Tropsch derived light base oils.

A base oil formulation according to the invention suitably has a VK 100 of 2.7 centistokes or less, for example from 2.6 to 2.3 centistokes.

It suitably has a VK 40 of 15 centistokes or less, preferably 11 centistokes or less, more suitably of 10 or 9 or 8 centistokes or less. Its VK 40 might for example be 9.6 centistokes or less, for example from 9 to 7.5 centistokes.

More preferably, if the base oil formulation is for use as a transformer oil, it may have a VK 40 of from 5 to 15 centistokes. If it is for use as a low temperature switch gear oil its VK 40 may be from 1 to 15 and more preferably from 1 to 4 centistokes.

A base oil formulation according to the invention suitably has a flash point (ASTM D-92) of 140° C. or higher, preferably 160° C. or higher, yet more preferably 180° C. or higher. These values may therefore represent the target flash point X as referred to below in connection with the sixth and seventh aspects of the invention. The flash point of the formulation may be tailored to suit its intended application; when intended for use in or as a dielectric fluid, for example, in particular in a high temperature environment, as low as possible a flash point will be desirable.

A base oil formulation according to the invention suitably has a pour point of −39° C. or lower, preferably −42 or −45 or −48 or −51° C. or lower.

The formulation will preferably be, overall, a low or ultra low sulphur formulation, or a sulphur free formulation, for instance containing at most 100 ppmw (parts per million by weight), preferably no more than 50 ppmw, most preferably no more than 10 or 5 ppmw, or even at or below the detection limit, of sulphur.

The formulation may contain other components in addition to the light base oil and the gas oil. It may for example contain one or more base oil additives of the type which are conventional for use in base oil formulations. The nature of any such additives will depend on the intended use of the formulation. They may for example be selected from anti-wear additives, antioxidants (for example hindered phenolics such as BHT), dispersants, detergents, viscosity modifiers, antifoaming agents, pour point depressants such as of the hydrocarbon or oxygenated hydrocarbon type, emulsifiers, demulsifiers, corrosion inhibitors, seal swell agents, anti-staining additives, UV-stabilisers and friction modifiers. The inclusion of an anti-wear additive, an antifoaming agent and/or a viscosity modifier may be particularly preferred where the formulation is for use in or as a shock absorber fluid.

Specific examples of such additives are described in for example the Kirk-Othmer Encyclopedia of Chemical Technology, third edition, volume 14, pages 477-526. Suitably the dispersant is an ashless dispersant, for example a polybutylene succinimide polyamine or Mannic base type dispersant. Suitably the detergent is an over-based metallic detergent, for example of the phosphonate, sulfonate, phenolate or salicylate type as described in the above mentioned Encyclopedia. Suitably the viscosity modifier is a viscosity modifying polymer, for example a polyisobutylene, an olefin copolymer, a polymethacrylate, a polyalkylstyrene or a hydrogenated polyisoprene star polymer (Shellvis). Examples of suitable antifoaming agents are polydimethylsiloxanes and polyethylene glycol ethers and esters.

In order to improve the gassing tendency of the base oil formulation it may be preferred to add an aromatic compound, for example from 0.05 to 10 wt % or from 0.1 to 5 wt % of an aromatic compound. Preferred aromatic compounds are for example tetrahydronaphthalene, diethylbenzene, diisopropylbenzene, or mixtures of alkylbenzenes such as are commercially obtainable as "Shell Oil 4697" or "Shellsol A 150" (both "Shell" products obtainable from Shell Deutschland GmbH). Another preferred mixture of aromatic compounds comprises a mixture of 2,6-di-t-butyl phenol and 2,6-di-t-butyl cresol. Preferably the base oil formulation comprises from 0.1 to 3 wt % of 2,6-di-t-butyl phenol and from 0.1 to 2 wt % of 2,6-di-t-butyl cresol, suitably in a weight ratio of from 1:1 to 1:1.5.

The base oil formulation may contain a copper passivator, sometimes referred to as an electrostatic discharge depressant or metal deactivator, for instance as described in WO-A-2006136594 at pages 16 to 18. Unless otherwise stated, the concentration of each such additional component in the base oil formulation is preferably up to 0.5 wt %, for example from 0.1 to 0.5 wt %, preferably below 0.4 or 0.3 or 0.2 wt %. (All additive concentrations quoted in this specification refer, unless otherwise stated, to active matter concentrations by mass. Further, all concentrations, unless otherwise stated, are quoted as percentages of the overall base oil formulation.)

If desired one or more additive components, such as those listed above, may be co-mixed—preferably together with suitable diluent(s)—in an additive concentrate, and the additive concentrate may then be dispersed into the light base oil, the gas oil or the base oil/gas oil mixture, in order to prepare a formulation according to the invention.

The total additive content in the base oil formulation, in particular when it is intended for use in or as a dielectric fluid, may suitably be from 0.2 to 0.5 wt %, preferably below 0.4 wt %. In general, low levels of additives are preferred, in particular when the base oil formulation is for use in or as a dielectric fluid. It may also preferred to use low levels of, or no, sulphur-containing additives, as these can increase the corrosivity of the base oil formulation.

Where a formulation according to the invention contains one or more cold flow additives, for example pour point depressants, such additives may be present at reduced concentrations due to the presence of the Fischer-Tropsch derived gas oil, as described below in connection with the ninth aspect of the invention. Thus for example, the formulation may contain 0.15 wt % or less of cold flow additives, in particular pour point depressants, suitably 0.1 wt % or less. In cases it may contain no cold flow additives at all.

A base oil formulation according to the invention is preferably suitable and/or adapted and/or intended for use as a dielectric fluid (for example, an electrical oil) and/or as a hydraulic fluid (for example a shock absorber fluid). It may be suitable and/or adapted and/or intended for use as a process oil, for example in the processing of a plastics material such as an elastomer, and/or as a refrigerator oil, and/or as an automatic transmission fluid.

The formulation may in particular be adapted for, and/or intended for, use in colder climates and/or during colder seasons. The cold flow performance of the formulation, when used in a system such as for example an electrical system or a vehicle shock absorber, can impact upon the overall performance of the system under such conditions.

According to a second aspect, the present invention provides the use of a Fischer-Tropsch derived gas oil in a base oil formulation containing a Fischer-Tropsch derived light base oil, for the purpose of improving the cold flow properties of the formulation, in particular whilst maintaining the flash point of the formulation above a desired target value.

A third aspect provides a method for formulating a Fischer-Tropsch derived light base oil, the method comprising (i) measuring the cold flow properties of the base oil and (ii) blending the base oil with a Fischer-Tropsch derived gas oil, in an amount sufficient to improve the cold flow properties of the blend. The cold flow properties of a base oil or base oil formulation can suitably be assessed by measuring its pour point, which is the lowest temperature at which movement of the formulation can be observed. A reduction in pour point indicates an improvement in cold flow properties, which in turn can increase the range of conditions in which the formulation can efficiently be used. Pour points can suitably be measured using the standard test method ASTM D-5950 or an analogous technique.

In general, an improvement in cold flow properties may be manifested by a reduction in the minimum temperature at which a system which uses the base oil formulation can perform to a given standard. In the context of the second and third aspects of the invention, "improving" the cold flow properties of the base oil formulation embraces any degree of improvement compared to the performance of the formulation before the Fischer-Tropsch derived gas oil is incorporated. This may for example involve adjusting the cold flow properties of the formulation, by means of the gas oil, in order to meet or improve upon a desired target, for instance a desired target pour point.

By using the invention, the pour point of the formulation may be reduced by at least 1° C. compared to its value prior to addition of the Fischer-Tropsch derived gas oil, preferably by at least 2° C., more preferably by at least 3 or 4 or 5° C.

By using the invention, the pour point of the formulation may be reduced by at least 0.2% of its value (expressed in Kelvin) prior to addition of the Fischer-Tropsch derived gas oil, more preferably by at least 0.4 or 0.5% and most preferably by at least 0.8 or 1 or 1.2%.

According to a fourth aspect of the invention, there is provided the use of a Fischer-Tropsch derived gas oil in a base oil formulation containing a Fischer-Tropsch derived light base oil, for the purpose of reducing the kinematic viscosity of the formulation, in particular whilst maintaining the flash point of the formulation above a desired target value.

A fifth aspect provides a method for formulating a Fischer-Tropsch derived light base oil, the method comprising (i) measuring the kinematic viscosity of the base oil and (ii) blending the base oil with a Fischer-Tropsch derived gas oil, in an amount sufficient to reduce the kinematic viscosity of the blend. The kinematic viscosity of a base oil or base oil formulation can suitably be measured using the standard test method D-445 or an analogous technique. It may for example be measured at 40 or 100° C.

In the context of the fourth and fifth aspects of the invention, "reducing" the kinematic viscosity of the base oil formulation embraces any degree of reduction compared to the kinematic viscosity of the formulation before the Fischer-Tropsch derived gas oil is incorporated. This may for example involve adjusting the kinematic viscosity of the formulation, by means of the gas oil, in order to meet or fall below a desired target.

By using the invention, the kinematic viscosity of the formulation at 100° C. (VK 100) may be reduced by at least 0.2 centistokes compared to its value prior to addition of the Fischer-Tropsch derived gas oil, preferably by at least 0.25 or 0.3 centistokes, more preferably by at least 0.4 or 0.5 centistokes. By using the invention, the VK 100 of the formulation may be reduced by at least 3% of its value prior to addition of the Fischer-Tropsch derived gas oil, more preferably by at least 3.5 or 5 or 10% and most preferably by at least 15 or 20 or 25%.

A base oil formulation prepared according to the invention may have a VK 100 of 2.6 centistokes or lower, preferably 2.5 or 2.4 or 2.3 centistokes or lower. According to a sixth aspect of the present invention there is provided a method for improving the cold flow properties and/or reducing the kinematic viscosity of a base oil formulation which contains a Fischer-Tropsch derived light base oil, whilst still achieving a target minimum flash point X for the formulation, which method comprises adding to the formulation a concentration c of a Fischer-Tropsch derived gas oil, wherein c is higher than the maximum concentration c' of the Fischer-Tropsch derived gas oil which theory would predict could be added to the formulation without reducing the flash point of the formulation below the target minimum X.

The theoretical maximum gas oil concentration, c', may be calculated according to the method described in Hydrocarbon Processing, Vol 42, June 1963 (Gulf Publishing Corp), MF 77-500 Physical and Engineering Data.

In embodiments of the invention, the actual gas oil concentration c may be 1 wt % higher than the predicted concentration c', preferably 2 or 3 or 4 or 5 wt % higher.

The present invention may be used to achieve a flash point (e.g. ASTM D-92) for the formulation which is higher than that predicted—for example using the above described method—to be possible using the same concentration of the Fischer-Tropsch derived gas oil, for example at least 1 or 2 or 5° C. higher, preferably at least 10 or 15 or 20° C. higher. The D-92 flash point achieved may be 5% or more higher than the predicted value, or in cases 6 or 7 or 8% or more higher.

A seventh aspect of the invention provides the use of a Fischer-Tropsch derived gas oil, in a base oil formulation containing a Fischer-Tropsch derived light base oil, for the dual purposes of:

a) achieving a target minimum flash point X for the formulation; and b) increasing the concentration c of the gas oil in the formulation, for example in order to improve the cold flow performance of the formulation and/or to reduce its kinematic viscosity, to a level above the maximum concentration c' which theory would predict could be added to the formulation without reducing its flash point below the target minimum X.

An eighth aspect of the invention provides the use of a Fischer-Tropsch derived gas oil, at a concentration c, in a base oil formulation containing a Fischer-Tropsch derived light base oil, for the purpose of improving the cold flow properties of the formulation and/or reducing its kinematic viscosity, whilst at the same time achieving a flash point for the formulation which is greater than that which theory would predict to be achievable using the Fischer-Tropsch derived gas oil in the formulation at concentration c.

If theory applied as expected to formulations containing both a Fischer-Tropsch derived light base oil and a Fischer-Tropsch derived gas oil, it would then be straightforward to calculate the amount of the gas oil which could be included in the formulation without reducing the flash point below a desired target minimum. However it has now been found that a Fischer-Tropsch derived gas oil can cause a non-linear, lower than expected, reduction in the flash point of a base oil formulation containing a Fischer-Tropsch derived light base oil. This allows a higher amount of the gas oil to be included in the formulation, in turn allowing greater improvements in cold flow performance and/or reductions in kinematic viscosity than would otherwise have been thought possible, ideally with lower concentrations of, or no, cold flow additives or viscosity improvers present, as discussed below.

A certain minimum flash point is often desirable in order for a base oil formulation to meet health and safety specifications, and/or to satisfy consumer demand. Equally, a certain level of cold flow performance (for example, a maximum pour point) may be desirable to meet relevant base oil specifications, as may a certain maximum kinematic viscosity. These standards will vary according to the intended use of the formulation.

According to the present invention, such standards may all be achievable simultaneously, in particular when the base oil formulation is intended for use in or as an electrical oil or shock absorber fluid, due to the inclusion of the Fischer-Tropsch derived gas oil. Moreover they may often be achievable with reduced levels of or no further additives present.

In the context of the present invention, "use" of a Fischer-Tropsch derived gas oil in a base oil formulation means incorporating the gas oil into the formulation, typically as a blend (i.e. a physical mixture) with one or more other fuel components (in particular the Fischer-Tropsch derived light base oil) and optionally with one or more base oil additives. The Fischer-Tropsch derived gas oil is conveniently incorporated before the formulation is introduced into a system (for example an electrical system, or a shock absorber system) which is to be run using the formulation. Instead or in addition the use may involve running such a system, using in it the base oil formulation containing the Fischer-Tropsch derived gas oil.

"Use" of a Fischer-Tropsch derived gas oil may also embrace supplying such a gas oil together with instructions for its use in a base oil formulation to achieve the purposes of one or more of the second to the eighth aspects of the invention, for instance to achieve a desired target level of cold flow performance (e.g. a desired target pour point), and/or a desired target viscosity or flash point, and/or (as described below in connection with the ninth aspect of the invention) to reduce the concentration of a cold flow or other additive in the formulation. The gas oil may itself be supplied as a component of a composition which is suitable for and/or intended for use as a base oil additive, in which case the gas oil may be included in such a composition for the purpose of influencing its effects on the cold flow properties, the viscosity and/or the flash point of a base oil formulation. Thus the Fischer-Tropsch derived gas oil may be incorporated into an additive composition or package along with one or more other base oil additives.

A base oil formulation, particularly one which is intended for use in colder climates and/or at colder times of the year, will often include one or more cold flow additives so as to improve its performance and properties at lower temperatures. In particular it may include one or more pour point depressants. Since the present invention may be used to improve the cold flow properties of a base oil formulation, it may also make possible the use of lower levels of such cold flow additives, and/or of other flow improver additives. In other words, inclusion of the Fischer-Tropsch derived gas oil potentially enables lower levels of cold flow additives to be used in order to achieve a desired target level of cold flow performance from the overall formulation, yet without undesirably high reductions in the flash point of the formulation.

Thus according to a ninth aspect of the invention, there is provided the use of a Fischer-Tropsch derived gas oil in a base oil formulation containing a Fischer-Topsch derived light base oil, for the purpose of reducing the concentration of a cold flow additive in the formulation, preferably without an undesirably high reduction in the flash point of the formulation, or with less of a reduction than theory would have predicted to occur due to the incorporation of the Fischer-Tropsch derived gas oil.

In the context of this ninth aspect of the invention, the term "reducing" embraces any degree of reduction—for instance 1% or more of the original cold flow additive concentration, preferably 2 or 5 or 10 or 20 or 50% or more—including reduction to zero. The reduction may be as compared to the concentration of the relevant additive which would otherwise have been incorporated into the base oil formulation in order to achieve the properties and performance required or desired of it in the context of its intended use. This may for instance be the concentration of the additive which was present in the formulation prior to the realisation that a Fischer-Tropsch derived gas oil could be used in the way provided by the present invention, or which was present in an otherwise analogous formulation intended (e.g. marketed) for use in an analogous context, prior to adding a Fischer-Tropsch derived gas oil to it.

In the case for example of a dielectric fluid, or a hydraulic fluid such as a shock absorber fluid, a certain level of cold flow performance may be desirable in order for the formulation to meet current base oil specifications, and/or to safeguard performance of a system containing the formulation, and/or to satisfy consumer demand, in particular in cold climates or seasons. According to the present invention, such standards may still be achievable even with reduced levels of cold flow additives, due to the inclusion of the Fischer-Tropsch derived gas oil.

A cold flow additive may be defined as any material capable of improving the cold flow properties of the formulation, as described above. It may be a material capable of improving the ability or tendency of the formulation to flow at any given temperature. In the context of the present invention, a cold flow additive may in particular be a pour point depressant. Known pour point depressants of use in base oil formulations include alkylated poly methyl methacrylates, and alkylated poly methyl methacrylate/N-methyl pyrollidone copolymers.

Such cold flow additives are conventionally included in base oil formulations so as to improve their performance at lower temperatures, and thus to improve the low temperature operability of systems which contain the formulations.

The (active matter) concentration of the cold flow additive in a base oil formulation prepared according to the invention may be up to 300 ppmw, preferably up to 200 or 100 or even 50 ppmw. Its (active matter) concentration may be at least 1 or 2 or 5 or 10 ppmw, although in cases may be zero.

According to a tenth aspect of the invention, there is provided a method for preparing a base oil formulation, such as a formulation according to the first aspect, the method involving obtaining a Fischer-Tropsch derived light base oil and blending it with a Fischer-Tropsch derived gas oil, optionally with one or more additives such as those referred to above. The blending may be carried out for one or more of the purposes described above in connection with the second to the ninth aspects of the invention, in particular with respect to the flash point, the cold flow properties and/or the kinematic viscosity of the resultant base oil formulation.

Such a method may involve obtaining a Fischer-Tropsch derived light base oil, separately obtaining a Fischer-Tropsch derived gas oil, and blending the two together, optionally with one or more additives such as those referred to above.

Also as described above, the light base oil and the gas oil may be derived from the same Fischer-Tropsch wax, and may be "back-blended" with one another, in appropriate proportions, typically downstream of their dewaxing and distillation.

A base oil formulation according to the invention may in particular be of use in, or more typically as, an electrical oil or dielectric fluid. Examples of its potential applications are in switch gears, transformers, regulators, circuit breakers, power plant reactors, cables and other electrical equipment. In particular the formulation may be for use in or as a transformer oil or a low temperature switch gear oil. Such applications are well known to the skilled person and described for example in "Lubricants and related products", Dieter Klamann, Verlag Chemie GmbH, Weinhem, 1984, at pages 330-337.

A problem often encountered in such applications, if using an electrical oil based on a naphthenic base oil, is too high a kinematic viscosity at −30° C. If such an oil is to be used in equipment requiring a low temperature start up, for instance below 0° C., the higher viscosity can have a negative effect on the heat dissipation properties of the electrical oil, often resulting in overheating of the equipment. Use of a base oil formulation according to the present invention can overcome or at least mitigate such problems.

Formulations according to the invention can furthermore exhibit very low dielectric dissipation factors, even after prolonged testing at elevated temperature. A low dissipation factor is indicative of a low loss of electrical power from a system in which an electrical oil is used. Thus because the dielectric dissipation factor of a base oil formulation according to the invention does not typically increase significantly over time, especially when compared to naphthenic electrical oil formulations, the formulation of the invention can help to increase the efficiency of an electrical system in which it is used.

In an embodiment of the present invention the base oil formulation may be used in or as a low temperature switch gear formulation. Traditionally low temperature switch gear formulations are prepared using low viscosity mineral base oils. However, a problem with known low temperature switch gear fluids is that they can have, as a result of their (low) viscometric properties, a low flash point. This problem can be even more pertinent in arctic regions requiring very low viscosities. In accordance with the present invention, in contrast, a switch gear fluid formulation having excellent viscometric properties at low temperatures can be prepared. A further advantage of such a formulation can be its relatively high flash point, which can allow the switch gear fluid to be safely used for highly critical switching operations, for example in a so-called high-load grid.

Low temperature switch gear oil formulations as described above may in particular find use in systems requiring frequent low temperature start up, especially more than 10 times per year and/or at a temperature of below 0° C., or below −5° C., where the temperature of the oil when the system is running is above 0° C.

Another preferred application of a base oil formulation according to the invention is as, or in, a fire resistant electrical oil. In such cases, the formulation preferably has a VK 100 of above 6 centistokes, more preferably above 7 and suitably below 12 centistokes. It has been found that paraffinic base oils with viscosities in this range have flash points greater than 250° C. and preferably greater than 260° C., making them very suitable for such applications, for which low flammability and improved fire safety characteristics are required. For example, a formulation according to the invention may be used as a transformer oil in an indoor or underground environment.

An eleventh aspect of the invention thus provides the use of a blend of a Fischer-Tropsch derived light base oil and a Fischer-Tropsch derived gas oil, for example a base oil formulation according to the first aspect of the invention, as or in a dielectric fluid. A twelfth aspect provides the use of such a blend as or in a shock absorber fluid. A thirteenth aspect provides the use of such a blend as or in a hydraulic fluid. Such uses may include use for one or more of the purposes described above in connection with the second to the ninth aspects of the invention.

In particular in the context of the eleventh aspect, the blend may be of particular value where the dielectric fluid is exposed to a high overall temperature, or where high peak temperatures or so-called "hotspots" occur in the fluid, or where an increase in temperature cannot easily be deferred by the fluid due to restrictions in size or heat exchange capacity of a device containing another electrical oil. Examples of such devices or applications are small high capacity transformers and safety switches.

The relatively high biodegradability of Fischer-Tropsch derived base oils, as compared to their mineral derived counterparts, can make a formulation according to the invention particularly advantageous for use in situations where biodegradability is a concern, for example as a transformer oil in mobile electrical equipment such as trains, electrically powered cars or hybrid powered cars. Formulations according to the invention may similarly find application in equipment for use in environmentally sensitive areas, such as for example national parks, conservation areas, water protection areas, potable water storage facilities and the like.

The biodegradability of a base oil formulation according to the invention may be further improved by the inclusion of an ester based base oil, for instance as described in WO-A-2006136594 at page 20 line 6 to page 21 line 16.

A fourteenth aspect provides a system, for example an electrical system, a hydraulic system, a shock absorber or a part thereof, which contains a base oil formulation according to the first aspect, and/or a base oil formulation prepared according to any one of the second to the tenth aspects.

Throughout the description and claims of this specification, the words "comprise" and "contain" and variations of the words, for example "comprising" and "comprises", mean "including but not limited to", and do not exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise. Preferred features of each aspect of the invention may be as described in connection with any of the other aspects.

Other features of the present invention will become apparent from the following examples. Generally speaking the invention extends to any novel one, or any novel combination, of the features disclosed in this specification (including any accompanying claims and drawings). Thus features, integers, characteristics, compounds, chemical moieties or groups described in conjunction with a particular aspect, embodiment or example of the invention are to be understood to be applicable to any other aspect, embodiment or example described herein unless incompatible therewith.

Moreover unless stated otherwise, any feature disclosed herein may be replaced by an alternative feature serving the same or a similar purpose.

The following examples illustrate the properties and performance of base oil formulations in accordance with the invention, and assess the effects of Fischer-Tropsch derived gas oils on the flash points of base oil formulations.

Example 1

A Fischer-Tropsch derived, catalytically dewaxed, light base oil, BO-1, was blended in a range of proportions with a Fischer-Tropsch derived, also catalytically dewaxed, gas oil GO-1. The effects of different gas oil concentrations on the flash points of the blends were measured using the standard test methods ASTM D-92 and D-93.

The kinematic viscosities of the blends were also measured at both 40 and 100° C. using the standard test method ASTM D-445. Pour points were determined using the standard test method ASTM D-5950, taking a mean from four readings.

The Fischer-Tropsch oil BO-1 had been prepared using a process of the general type described above, including relatively severe hydroprocessing and catalytic dewaxing steps. Its properties, and those of the gas oil GO-1, are shown in Table 1 below.

TABLE 1

| Property | Testmethod | BO-1 | GO-1 |
|---|---|---|---|
| VK 40 (centistokes) | ASTM D-445 | 9.581 | 3.128 |
| VK 100 (centistokes) | ASTM D-445 | 2.68 | 1.255 |
| Viscosity index | ASTM D-2270 | 119 | |
| Brookfield dynamic viscosity at −40° C. (centipoise) | ASTM D-2983 | 3120/3220 | 50/40 |
| Brookfield dynamic viscosity at −25° C. (centipoises) | ASTM D-2983 | 180/180 | |
| Total polars content: | IP-368 mod | 0.7 | |
| Aromatics (wt %) | | 99.5 | 0.6 |
| Saturates (wt %) | | 100.2 | 99.5 |
| Recovery (wt %) | | | 100.1 |
| Digital density at 15° C. ($kg/m^3$) | IP-365/97 | 806.6 | 781.8 |
| Filterability (mins) | TMS-371 | 6 | |
| Noack volatility (wt %) | CEC L-40-A-93 | 42.4 | >75 |
| Flash point D-93 (° C.) | ASTM D-93 | 185.5 | 104.0 |
| Flash point D-92 (° C.) | ASTM D-92 | 198.0 | 112.0 |
| Pour point (° C.) | ASTM D-5950 | −42 | −51 |
| Pour point response (+0.15% L 223) (° C.) | ASTM D-5950 | −69 | −60 |
| Cloud point (° C.) | ASTM D-5771 | −29 | −38 |
| Saybolt colour | ASTM D-156 | +30 | — |
| Aniline point (° C.) | IP-2 | 113.0 | 97.4 |
| Air release (mins) | IP-313 | <0.5 | |
| Water separability: separation time (mins) | ASTM D-1401 | 40-40-05 | |
| Simulated distillation (° C.): | ASTM D-2887 | | |
| IBP | | 340.0 | 143.8 |
| 5% | | 354.0 | 167.8 |
| 10% | | 359.0 | 187.8 |
| 15% | | 363.5 | 199.6 |
| 20% | | 367.0 | 210 |
| 25% | | 370.0 | 221 |
| 30% | | 373.0 | 230.4 |
| 35% | | 376.0 | 240.6 |
| 40% | | 378.5 | 249.4 |
| 45% | | 381.0 | 258.4 |
| 50% | | 383.5 | 266.8 |
| 55% | | 386.0 | 275 |
| 60% | | 388.0 | 282.8 |
| 65% | | 390.5 | 290.4 |
| 70% | | 392.5 | 297.4 |
| 75% | | 394.5 | 304.2 |
| 80% | | 396.5 | 310.6 |
| 85% | | 399.0 | 317.2 |
| 90% | | 401.5 | 324.2 |
| 95% | | 404.5 | 332.2 |
| FBP | | 414.0 | 350 |

The results of the experiments are shown in Table 2 below. The table also shows predicted D-92 flash points for the blends, calculated using the method described in Hydrocarbon Processing, Vol 42, June 1963 (Gulf Publishing Corp), MF 77-500 Physical and Engineering Data, and for each blend the percentage increase in measured flash point relative to the predicted value.

TABLE 2

| Base oil BO-1 (wt %) | Gas oil GO-1 (wt %) | Flash point (° C.) (ASTM D-93) | Measured flash point (° C.) (ASTM D-92) | Predicted D-92 flash point (° C.) | % flash point benefit cf theory | Pour point (° C.) (ASTM D-5950) | VK 40 (cSt) | VK 100 (cSt) |
|---|---|---|---|---|---|---|---|---|
| 100 | 0 | 185.5 | 196 | 196 | — | −42 | 9.6 | 2.7 |
| 95 | 5 | 164.5 | 188 | 174 | 8.05 | −45 | 9.1 | 2.6 |
| 90 | 10 | 148 | 172 | 162 | 6.17 | −44.25 | 8.6 | 2.5 |
| 80 | 20 | 134 | 156 | 147 | 6.12 | −45 | 7.7 | 2.3 |
| 0 | 100 | 104 | 112 | 112 | — | −51 | 3.1 | 1.3 |

It can be seen that inclusion of the gas oil results in an advantageous reduction in the pour points of the resultant blends. It does not however, at concentrations up to 20 wt %, reduce the D-92 flash points of the blends below the 140° C. minimum desired for a typical electrical oil. This is surprising: the flash point of the pure gas oil is far lower than that of the base oil and the gas oil would be expected (by analogy with solvents in base oils) to dominate the vapour pressure, and hence the flash point, of a base oil/gas oil blend. Thus it would be expected that incorporation of the gas oil into the base oil would make it difficult to achieve a blend flash point of 140° C. or greater. Instead the D-92 flash points of the blends prepared according to the invention can be seen to be consistently higher than predicted by theory.

Table 2 also shows that the gas oil helps to reduce the kinematic viscosities of the blends, which again can be desirable in the context of electrical oils and shock absorber fluids, and can be used to help tailor a base oil formulation to a desired product specification. Thus the present invention can make possible the preparation of base oil formulations which can be highly suitable for use as either dielectric fluids or shock absorber fluids. It also allows the properties (in particular the viscosity and the pour point) of a Fischer-Tropsch derived light base oil to be more readily tailored, without undue detriment to its flash point.

What is claimed is:

1. A base oil formulation consisting essentially of (i) a Fischer-Tropsch derived light base oil and (ii) a Fischer-Tropsch derived gas oil wherein the concentration of the Fischer-Tropsch derived gas oil is from 1 to 20 wt %.

2. A base oil formulation according to claim 1, wherein the Fischer-Tropsch derived gas oil has a pour point (ASTM D-5950) of −42° C. or below.

3. A base oil formulation according to claim 1, wherein the concentration of the Fischer-Tropsch derived gas oil is from 5 to 10 wt %.

4. An electrical oil or hydraulic fluid containing a base oil formulation according to claim 1.

5. A method for preparing a base oil formulation, the method comprising obtaining a Fischer-Tropsch derived light base oil and blending it with a Fischer-Tropsch derived gas oil wherein the concentration of the Fischer-Tropsch derived gas oil is from 1 to 20 wt %.

6. A method for improving the cold flow properties and/or reducing the kinematic viscosity of a base oil formulation which contains a Fischer-Tropsch derived light base oil, whilst still achieving a target minimum flash point X for the formulation, which method comprises adding to the formulation a concentration c of a Fischer-Tropsch derived gas oil, wherein c is higher than the maximum concentration c' of the Fischer-Tropsch derived gas oil which theory would predict could be added to the formulation without reducing the flash point of the formulation below the target minimum X wherein the concentration of the Fischer-Tropsch derived gas oil is from 1 to 20 wt %.

* * * * *